US010595636B2

(12) United States Patent
Jin et al.

(10) Patent No.: US 10,595,636 B2
(45) Date of Patent: Mar. 24, 2020

(54) SEAT STRUCTURE AND CHAIR

(71) Applicant: UE FURNITURE CO., LTD, Zhejiang (CN)

(72) Inventors: Minghua Jin, Zhejiang (CN); Jingzhi Xia, Zhejiang (CN); Zhengfu Ruan, Zhejiang (CN)

(73) Assignee: UE FURNITURE CO., LTD, Zhejiang (CN)

( * ) Notice: Subject to any disclaimer, the term of this patent is extended or adjusted under 35 U.S.C. 154(b) by 0 days.

(21) Appl. No.: 16/051,510

(22) Filed: Aug. 1, 2018

(65) Prior Publication Data

US 2018/0332967 A1 Nov. 22, 2018

Related U.S. Application Data

(63) Continuation of application No. PCT/CN2017/100291, filed on Sep. 1, 2017.

(30) Foreign Application Priority Data

Sep. 1, 2016 (CN) ..... 2016 2 1081836 U
Dec. 5, 2016 (CN) ..... 2016 2 1368953 U

(51) Int. Cl.
*A47C 3/021* (2006.01)
*A47C 3/025* (2006.01)
(Continued)

(52) U.S. Cl.
CPC ..... *A47C 1/03272* (2013.01); *A47C 1/03255* (2013.01); *A47C 3/026* (2013.01); *A47C 7/443* (2013.01)

(58) Field of Classification Search
CPC . A47C 1/03255; A47C 1/03272; A47C 3/026; A47C 7/443
(Continued)

(56) References Cited

U.S. PATENT DOCUMENTS 4,362,335 A * 12/1982 Drabert ..... A47C 7/441 297/285 X
4,408,800 A * 10/1983 Knapp ..... A47C 1/0244 297/285 X
(Continued)

FOREIGN PATENT DOCUMENTS

CN 103108572 5/2013
CN 104223821 12/2014
(Continued)

*Primary Examiner* — Rodney B White
(74) *Attorney, Agent, or Firm* — JCIPRNET

(57) ABSTRACT

A seat structure comprises a base configured to be a chair base assembly; a seat support located above the base, wherein a front part of the seat support has rotary connection with the front part of the base through a transition link; a chair back assembly having rotary connection with a rear part of the base through a pivot; a lever driving member linked between the chair back assembly and the seat support, and having rotary connection with a rear part of the seat support, wherein the lever driving member and the seat support are approximately on the same surface. When the chair back assembly rotates rearward around the pivot from the initial position, the rear part of the seat support is raised diagonally to the rear through the lever driving member, meanwhile the transition link and the front part of the seat support are pulled up.

14 Claims, 19 Drawing Sheets

(51) Int. Cl.

| | |
|---|---|
| ***A47C 3/026*** | (2006.01) |
| ***A47C 7/54*** | (2006.01) |
| ***A47C 1/032*** | (2006.01) |
| *A47C 7/44* | (2006.01) |

(58) Field of Classification Search
USPC ..... 297/285, 286, 289, 292, 293, 296, 297
See application file for complete search history.

(56) References Cited

U.S. PATENT DOCUMENTS 4,471,994 A * 9/1984 Zund ..... A47C 1/03255 297/300.3
4,533,177 A * 8/1985 Latone ..... A47C 3/026 297/285
4,585,272 A * 4/1986 Ballarini ..... A47C 3/12 297/285 X
4,641,885 A * 2/1987 Brauning ..... A47C 1/03277 297/292 X
4,703,974 A * 11/1987 Brauning ..... A47C 7/004 297/285 X
4,744,603 A * 5/1988 Knoblock ..... A47C 1/03255 297/285
4,765,679 A * 8/1988 Lanuzzi ..... A47C 1/03255 297/300.3
4,889,385 A * 12/1989 Chadwick ..... A47C 3/026 297/285 X
4,981,326 A * 1/1991 Heidmann ..... A47C 3/026 297/285
5,100,200 A * 3/1992 Keusch ..... A47C 1/03238 297/296
5,102,196 A * 4/1992 Kaneda ..... A47C 7/405 297/285
5,193,880 A * 3/1993 Keusch ..... A47C 1/03255 297/296
5,401,077 A * 3/1995 Hosoe ..... A47C 1/03 297/312
5,957,534 A * 9/1999 Wilkerson ..... A47C 1/03255 297/301.1
6,296,309 B1 * 10/2001 Kurtz ..... A47C 3/12 297/297
7,806,478 B1 * 10/2010 Cvek ..... A47C 1/03255 297/300.1
10,194,750 B2 * 2/2019 Ludwig ..... A47C 1/03277
2007/0290537 A1 12/2007 Lin
2008/0217977 A1 * 9/2008 Aldrich ..... A47C 1/023 297/285 X
2009/0212617 A1 * 8/2009 Krob ..... A47C 1/03233 297/316
2010/0259082 A1 * 10/2010 Votteler ..... A47C 1/03255 297/285
2012/0205952 A1 * 8/2012 Takeuchi ..... A47C 1/03 297/300.1
2013/0313883 A1 * 11/2013 Machael ..... A47C 1/03294 297/452.18
2018/0295996 A1 * 10/2018 Ludwig ..... A47C 1/03277

FOREIGN PATENT DOCUMENTS

CN 103108572 10/2015
CN 105640117 6/2016
CN 206603492 11/2017
EP 3120732 A1 * 1/2017 ..... A47C 1/03294
JP 2008212622 9/2008
WO 8602536 5/1986

* cited by examiner

SEAT STRUCTURE AND CHAIR

CROSS-REFERENCE TO RELATED APPLICATION

This is a continuation of International Application No. PCT/CN2017/100291, filed on Sep. 1, 2017, which claims the priority benefits of China Application No. 201621081836.X, filed on Sep. 1, 2016 and China Application No. 201621368953.4, filed on Dec. 5, 2016. The entirety of each of the above-mentioned patent applications is hereby incorporated by reference herein and made a part of this specification.

BACKGROUND

Technical Field

This invention relates to the technical field of chair, swivel chair, office chair, etc., in particular to a seat structure and chair.

Description of Related Art

Swivel chair chassis, also known as swivel chair tray, is an important component under the seat cushion. The lift and fall of the seat cushion as well as the tilt angle adjustment of the chair back all rely on the chassis to realize.

In the prior art, there is already a device synchronizing the back and the seat. For example, the Chinese Patent Literature (publication date: Dec. 24, 2014, publication patent No.: CN104223821A) discloses a kind of swivel chair chassis comprising a base, a bracket and a tilting plate, wherein the bracket is installed inside the base and the tilting plate is installed inside the bracket. The first pin shaft, the second pin shaft, the third pin shaft, the fourth pin shaft, the tilting plate, the first connecting link and the second connecting link of the patent form a four-point linkage mechanism, enabling transmission of the force. The chair back is connected and fixed to the tilting plate, providing driving force of the four-point linkage mechanism. The gravity applied to the chair seat by human body forms a restoring force applied to the four-point linkage mechanism through the third pin shaft which is hinged on the bracket, and the driving force and the restoring force of the four-point linkage mechanism form a confrontation relationship. It makes it easy for people whoever weigh less or heavier to lean up and get back up, so that everyone with different weight can get the most reasonable matching restoring force.

The Chinese Patent Literature (publication date: Oct. 7, 2015, publication patent no.: CN103108572B) discloses a tilting mechanism for chairs, comprising a base, a backrest bracket for supporting the chair back and a connecting device for connecting said backrest bracket to said base. Said connecting device includes a guide rail and a guide member, one of which is provided on the backrest bracket extending from the back joint portion to the pivot connection portion, wherein said backrest bracket may be hinged to the chair seat at said pivot connection portion, while the other is provided on said base. When said connecting device connects said backrest bracket to said base, said backrest bracket rotates around the pivot of said pivot connection portion, making said guide member and said guide rail move relative to each other, thus realizing the movement of said pivot connection portion relative to said base.

The above-mentioned technical solution is designed to avoid the need for a component on the rear of the chair back and across the significant part of the chair back, and provides a kind of tilt mechanism that improves comfort, realizes various structures to coordinate the movement of the back and seat of a chair. The technical solution is realized by lifting the whole chair seat rearward. Due to its complex design of its overall structure, the user needs to apply enough force rearward, therefore it's not suitable for everybody. Moreover, looking from aesthetic aspect, this kind of chair does not meet the needs of modern streamlined aesthetic, furthermore, it is not convenient to configure one piece mesh fabric that connects the back and the seat of a chair into a whole, instead, mesh fabric for the chair back and mesh fabric for the chair seat have to be configured separately.

SUMMARY

To overcome the shortcomings of the above-mentioned prior art, the present invention provides a seat structure and its application on chair which is simple in structure, aesthetically pleasing in appearance, and convenient in configuring the back and the seat of a chair as a whole with one piece mesh fabric, meanwhile it's able to lift the chair seat up when the chair back is leaning rearward. The seat structure can be used by different people and people of different weights. It overcomes the uncomfortable feeling of the user as the user has to apply great enough waist strength to make the seat of prior art raised as a whole, thus increasing comfort for different human body. Besides, throughout the process, any user can easily lean up and get back up and finds his/her comfort points in different positions.

The present invention is achieved by the following technical solution:

A seat structure comprising:

A base, configured to be the chair base assembly;

A seat support, which is located above the base, wherein the front part of the seat support has rotary connection with the front part of the base through a transition link;

A chair back assembly, which has rotary connection with the rear part of the base through pivot;

A lever driving member, which is linked between the chair back assembly and the seat support; the lever driving member has rotary connection with the rear part of the seat support; said lever driving member and the seat support are approximately on the same surface; when the chair back assembly rotates rearward around the pivot from the initial position, the rear part of the seat support is raised diagonally to the rear through the lever driving member, meanwhile the transition link and the front part of the seat support are pulled up.

The present seat structure forms a four-bar linkage mechanism by means of a seat support which has rotary connection with the front part of the base through a transition link, a chair back assembly and a lever driving member. When in use, the base is stationary, while the force applied on the chair back assembly by human body transfers mutually among the lever driving member, the chair back assembly and the seat support that have rotary connection, thus driving the seat support to be lifted up and down on the base, and then realizing tilt back and forth. More importantly, the lever driving member is approximately parallel to the base, and the lever driving member is roughly on the same surface as the seat support, so that the chair back assembly is connected to the chair seat as a whole to facilitate the configuration of an integral mesh fabric, which means the mesh fabric can be connected from top to bottom without being divided. The seat structure can be applied to anyone, and there are no restrictions on manufacturing materials. When used by different users, there is no need to exert a force to lift the entire seat, so that it can be easily tilted back and forward. Due to the different force of different occupants when leaning rearward, the force transmission between the chair back assembly and the lever driving member is different, making it different in terms of how much the seat support is raised and how much the seat tilts rearward, thus meeting different occupants' requirements on comfort.

A chair comprising:

Said seat structure;

A base assembly for supporting the seat structure;

A mesh fabric, which is stretched from top to bottom on the chair back assembly, the lever driving member and the seat support; said mesh fabric is connected as a whole from top to bottom.

As the second preferred embodiment:

A seat structure comprising:

A base, configured to be the chair base assembly;

A seat support, which is located above the base, wherein the front part of the seat support has rotary connection with the front part of the base through a transition link;

A chair back assembly, which has rotary connection with the rear part of the base through pivot;

A lever driving member, which is linked between the chair back assembly and the seat support; the lever driving member has rotary connection with the rear part of the seat support; said lever driving member and the seat support are approximately on the same surface; when the chair back assembly rotates rearward around the pivot from the initial position, the rear part of the seat support is raised diagonally to the rear through the lever driving member, meanwhile the transition link and the front part of the seat support are pulled up;

A reset spring, which is installed longitudinally between the chair back assembly and the base; when the chair back assembly rotates rearward, the reset spring produces reaction force.

The reset spring of the present solution is installed longitudinally between the chair back assembly and the base, which makes the lever driving member exert force directly on it during rotation, providing sufficient reset force for the deformation of the reset spring.

The design starting point, philosophy and benefits of the present invention which adopts the above-mentioned technical solution are:

Firstly, the present invention provides a seat structure, which forms a closed annular lever arm structure, that's to say, the chair back assembly, the seat support, the transition link and the base form a four-bar linkage mechanism. The base is stationary, while the transition link and the front & rear part of the seat support are lifted up by the lever driving member when the chair back assembly is rotating. The driving force of the chair back assembly and the restoring force of the seat support form a confrontation relationship, therefore it's easy for people whoever weigh less or heavier to lean up and get back up, thus making the occupant feel comfortable while seated.

Moreover, the lever driving member is approximately parallel to the base, and the lever driving member is roughly on the same surface as the seat support, so that the chair back assembly is connected to the chair seat as a whole to facilitate the configuration of an integral mesh fabric, which means the mesh fabric can be connected from top to bottom without being divided, making the appearance more smooth and aesthetically pleasing.

The seat structure of the present invention provides a relatively stable support by installing the base. In addition, the seat support is suspended, and the front end of the seat support has rotary connection with the front end of the base, while the chair back assembly has rotary connection with the rear end of the base. Therefore, when the chair back assembly rotates, force transmission is enabled by the lever driving member, which provides an upward force to the seat support, lifting the seat support up. The gravity applied to the seat support by human body forms a restoring force to reset the seat support. The driving force of the chair back assembly and the restoring force of the seat support form a confrontation relationship. It makes it easy for people whoever weigh less or heavier to lean up and get back up, thus applying to wider range of people.

Furthermore, a reset device is set up to assist in the reset of the chair back assembly. The reset device consists of at least one reset compression spring. The number of reset compression springs can be set according to body weight and other indicators. Due to the existence of the base, no matter how many the reset compression springs there are, the reset device is placed inside the space enclosed by the base and the connecting member without occupying extra space, so that the overall appearance of the seat is more aesthetically pleasing; the seat structure can be tilted rearward to different degrees according to the force applied by different human body to meet the needs of different occupants.

Specifically, when a person sits on the seat, the rearward force applied by the human body on the chair back assembly is transferred to the lever driving member through the chair back assembly, and the lever driving member drives the seat support to be lifted up and moved rearward, and in this case, the chair back assembly and the connecting member rotate simultaneously rearward around the base and reach the rearward position. When human body tilts forward, the force applied on the chair back assembly disappears, and the chair back assembly moves forward with the restoring force of the reset device, and in this case the seat support further presses the lever driving member to make it reset under human gravity, and the seat support returns to its original static position, i.e. the initial position. It applies to a wider range of people. The reset force can be set differently up to different occupants, so as to exert different rearward force, making it more universal.

In general, the present invention provides a gravity adaptive seat that requires no manual adjustment, is more humanized, and has better versatility. The restoring force of the chair back is matched to the weight of the body, so that people, whether light or heavy, can easily lean back and get up.

Furthermore, in the process of leaning back, the seat support, namely the chair seat, also moves rearward with the rotation of the chair back, so that the lumbar support always matches the corresponding position of the back of human body, thus preventing the lumbar support separating from the waist and the waist being suspended. It also avoids friction between clothes and the chair back.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The technical solution of the present invention is further explained in detail through embodiment with drawings.

First of all, the reference positions of the components in the present invention are defined. Taking the seat under normal service condition as the reference, the front of the seat is the front, and the rear of the seat including the position of the chair back assembly is the rear.

Figure 1:
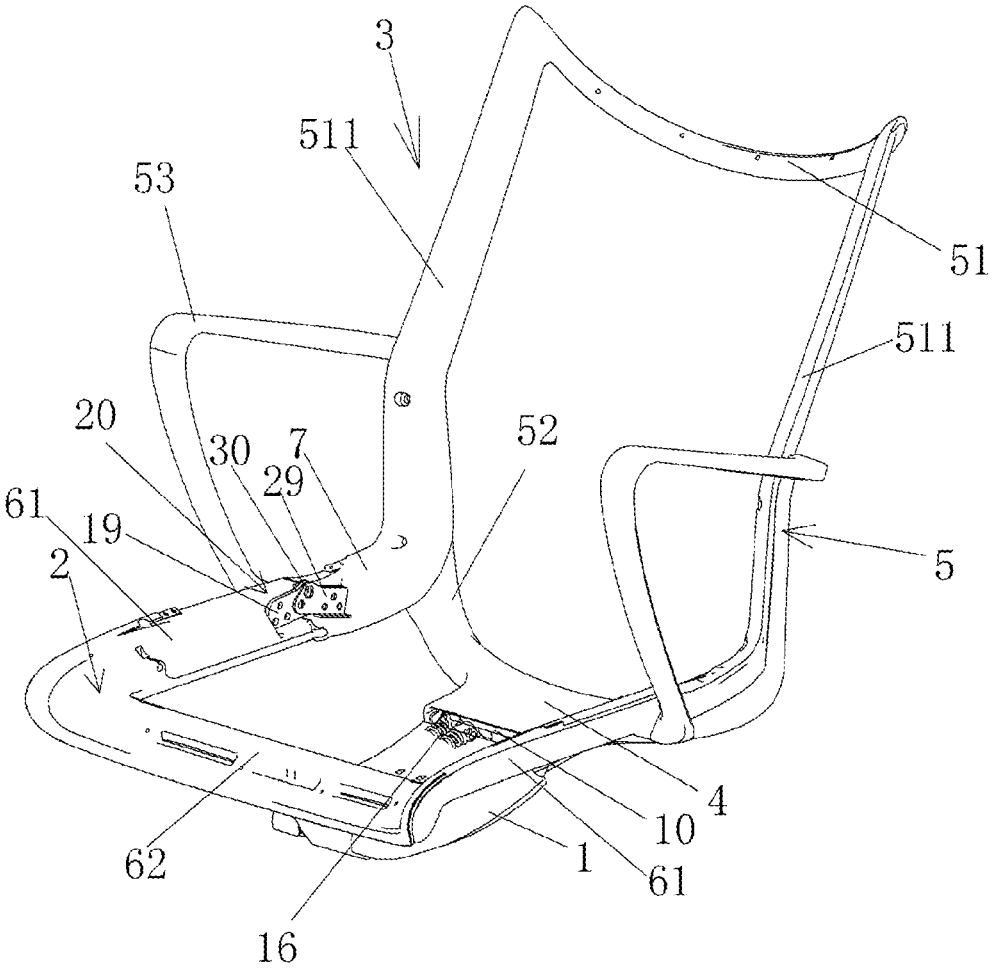
FIG. 1 is a schematic view of the seat structure in the present invention.
Figure 2:
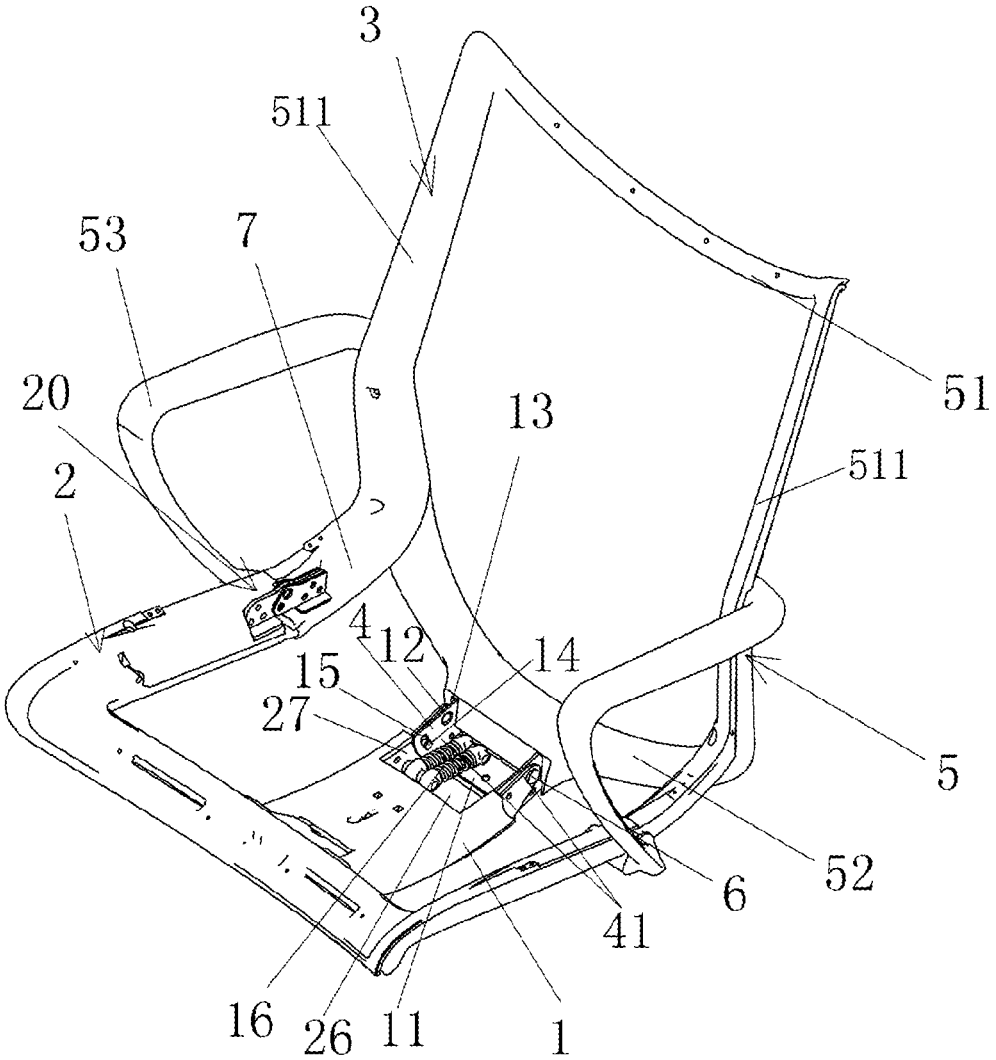
FIG. 2 is a schematic view of the seat structure in the present invention from another angle.

Embodiment 1:

A seat structure in the embodiment shown in FIG. 1, FIG. 2, comprising:

Base 1, configured to be the chair base assembly; metal base is preferred for base 1; the chair base assembly (not shown) includes supporting column, a plurality of supporting legs extending radially from the lower end of the supporting column and casters supporting the leg ends. Said supporting column can be an air rod.

Seat support 2. Seat support 2 is installed above base 1 and remains approximately parallel with base 1, wherein seat support 2 has rotary connection with the front end of base 1 through a transition link 8. Said seat support 2 comprises two bilaterally symmetrical supporting bars 61. The front parts of the two supporting bars 61 are connected as a whole through cross bar 62, wherein cross bar 62 has rotary connection with the front part of base 1 through transition link 8. The font end of seat support 2 is bending and extending downward and rearward into human body sitting position structure, and seat support 2 has rotary connection with base 1 in a frame structure. The sitting position structure is in line with ergonomics, which makes the human body feel more comfortable and the legs feel better.

Both ends of transition link 8 are provided with an arc-shaped connecting link limit structure 25 respectively; the first limit structure 9 is installed at one end of seat support 2 which is connected to transition link 8 corresponding to the connecting link limit structure; the second limit structure 21 is installed at the junction where base 1 and transition link 8 have rotary connection. The first limit structure 9 is an arc-shaped limit block, while the second limit structure 21 is an arc-shaped limit block or a limit pin or a limit tooth. In this embodiment, the second limit structure 21 is a limit pin (see FIG. 3). When the transition link rotates, said limit structure can act as a limit to prevent over stroke; moreover, in the initial state, said limit structure can provide an effective support to the seat support and prevent it from being collapsed.

Chair back assembly 3 comprises connecting member 4 and bracket 5, wherein connecting member 4 has rotary connection with the rear part of base 1 through pivot 6, and when bracket 5 rotates, it drives connecting member 4 rotating around pivot 6; connecting member 4 serves as connecting bond between chair back assembly 3 and base 1. Said bracket 5 comprises upper supporting frame of the back 51 and side supporting frames 511 which are extending downward along the left and right side of upper supporting frame of the back 51. The lower ends of both side supporting frames 511 meet in the middle to form lower supporting frame of the back 52. Lower supporting frame of the back 52 extends forward and gets connected with connecting member 4; supporting bar 61 is linked with side supporting frame 511 by handrail 53.

Lever driving member 7 is linked between said bracket 5 and seat support 2, and the two lever driving members 7 have rotary connection with the rear part of the two supporting bars 61 respectively; corresponding to seat support 2 there are two said lever driving members 7 of lateral symmetry, and lever driving member 7 is formed by extending forward from the middle and lower part of side supporting frame 511; lever driving member 7 is approximately on the same surface as seat support 2, which means lever driving member 7 and supporting bar 61 are approximately connected in a straight line and both stay approximately parallel to base 1. In this way, chair back and chair seat are integrated together, which facilitates the configuration of mesh fabric. Said lever driving member and seat support being roughly on the same surface does not mean that both are in the same plane everywhere. In a broad sense the case where the angle between the two is greater than 20 degrees is excluded. It is more appropriate that too large abrupt deformation will not occur to the seat, that is to say, the configuration should be simple and smooth.

Lever driving member 7 is not capable of driving on its own, instead it relies on chair back assembly 3 to transfer force by rotation; when bracket 5 turns rearward from the initial position, seat support 2 is lifted up by lever driving member 7; when bracket 5 is reset, seat support 2 is reset to the initial position by lever driving member 7. Bracket 5 is an integrated member to match human back structure.

Base 1 comprises a base plate 26 and two side plates 27 (see FIG. 5), wherein base plate 26 is arranged in an arc-shaped structure in fore-and-aft direction. Connecting member 4 presents a U-shape structure, to be specific, connecting member 4 has two arms 41 which are spaced away from each other. The front end of connecting member 4, i.e. arm 41 corresponds to the rear end of base 1, able to make relative rotary connection.

The two arms 41 of connecting member 4 and the two side plates 27 of base 1 are respectively provided with pivot hole 12 at the rotation junction. Connecting member 4 has rotary connection with base 1 through pivot 6 which is installed inside pivot hole 12.

Figure 3:
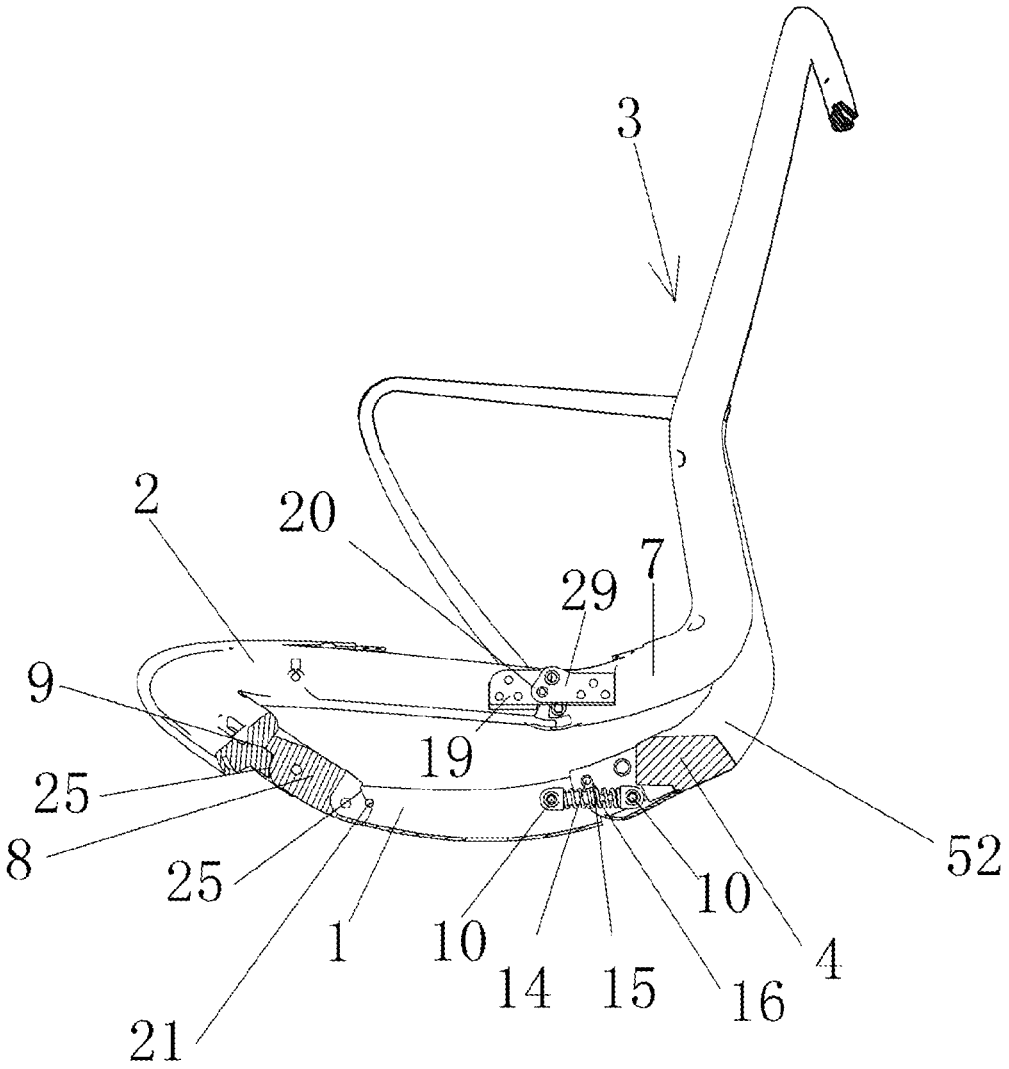
FIG. 3 is an original state diagram of one side of the seat structure in the present invention.
Figure 5:
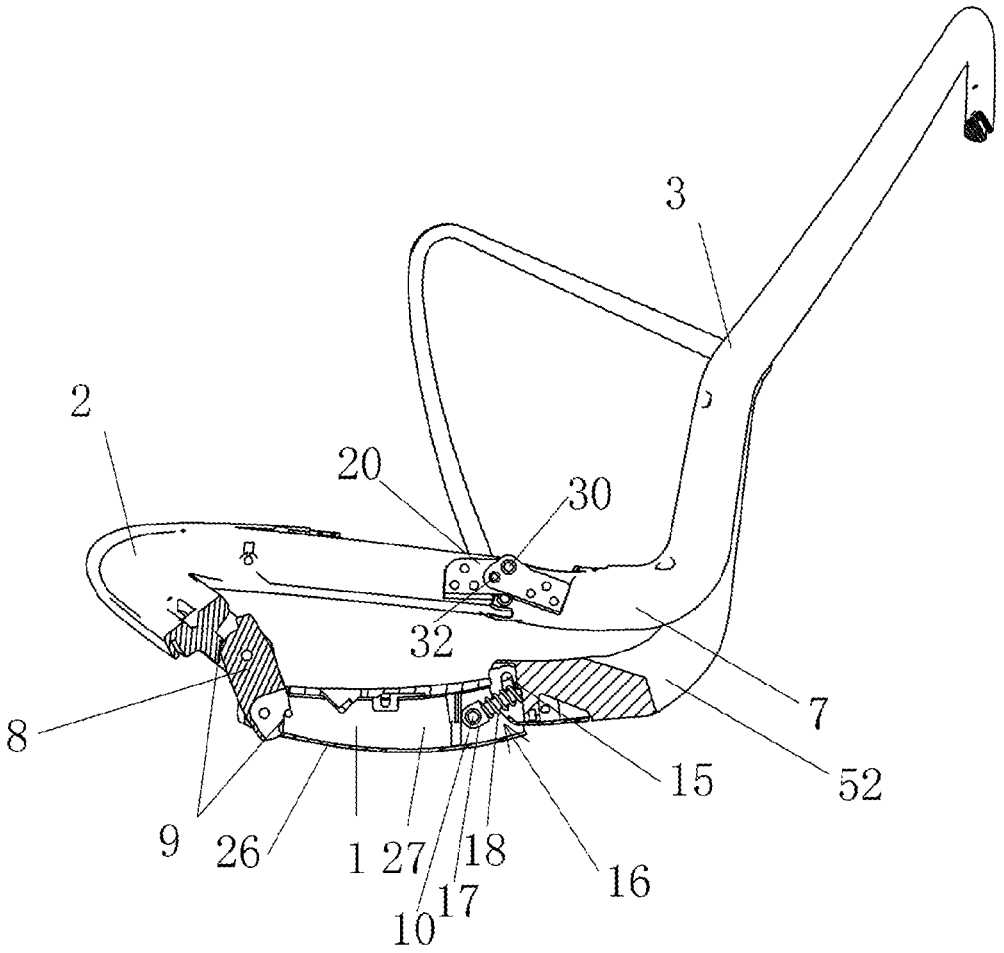
FIG. 5 is a cutaway view of the rearward state of one side of the seat structure in the present invention.

Either base 1 or connecting member 4 is provided with long limit hole 15, while the other provided with limit axis 14 (see FIG. 3, FIG. 5). Long limit hole 15 is located in front of pivot hole 12, and connecting member 4 realizes the limit on forward and rearward tilt through limit axis 14. Both sides of the rear end of connecting member 4 are provided with fixed clamp structure 13 to correspond to bracket 5.

As shown in FIGS. 2, 3, 5, 7, 8, reset device 16 is provided between base 1 and connecting member 4; to be specific, reset device 16 consists of 2-5 reset compression springs arranged in parallel, wherein the two ends of the reset compression spring are connected to base 1 and connecting member 4 respectively; to be specific, a pin shaft 10 is provided horizontally on base 1 and connecting member 4 respectively, and the two ends of the reset compression spring are connected with pin shafts 10 of base 1 and connecting member 4 respectively. The reset compression spring includes a compression spring body 18 and connecting pedestals 17 which are installed at both ends of the compression spring body, wherein connecting pedestal 17 is provided with axle hole 42, and said pin shaft 10 is installed in axle hole 42 of connecting pedestal 17. The two pin shafts 10 are installed on the base and the connecting member respectively. When connecting member 4 rotates, the pin shaft on connecting member 4 rotates around the pivot shaft and gets close to the pin shaft on the base, while the reset compression spring is linked between the two pin shafts which gets compressed and deformed, resulting in resilience.

Lever driving member 7 is integrated with bracket 5 as one; or lever driving member 7 and bracket 5 are separated but fixed to each other. In the present embodiment lever driving member 7 is integrated with bracket 5 as one.

Lever driving member 7 has rotary connection with seat support 2 through a set of connecting link 20. Connecting link 20 comprises the first connecting link 19 and the second connecting link 29, wherein the first connecting link 19 and seat support 2 are fixed to each other by three screws, and the second connecting link 29 is fixed to lever driving member 7 by three screws. The first connecting link 19 has rotary connection with the second connecting link 29 through axis 30. Either one of the first connecting link 19 and the second connecting link 29 is provided with limit hole 31, while the other is provided with limit pin shaft 32. Limit pin shaft 32 is inserted in limit hole 31. The setting of the limit structure is able to realize limits on forward and rearward tilting of the seat support, thus ensuring the user tilt back and forth within comfortable range.

Figure 4:
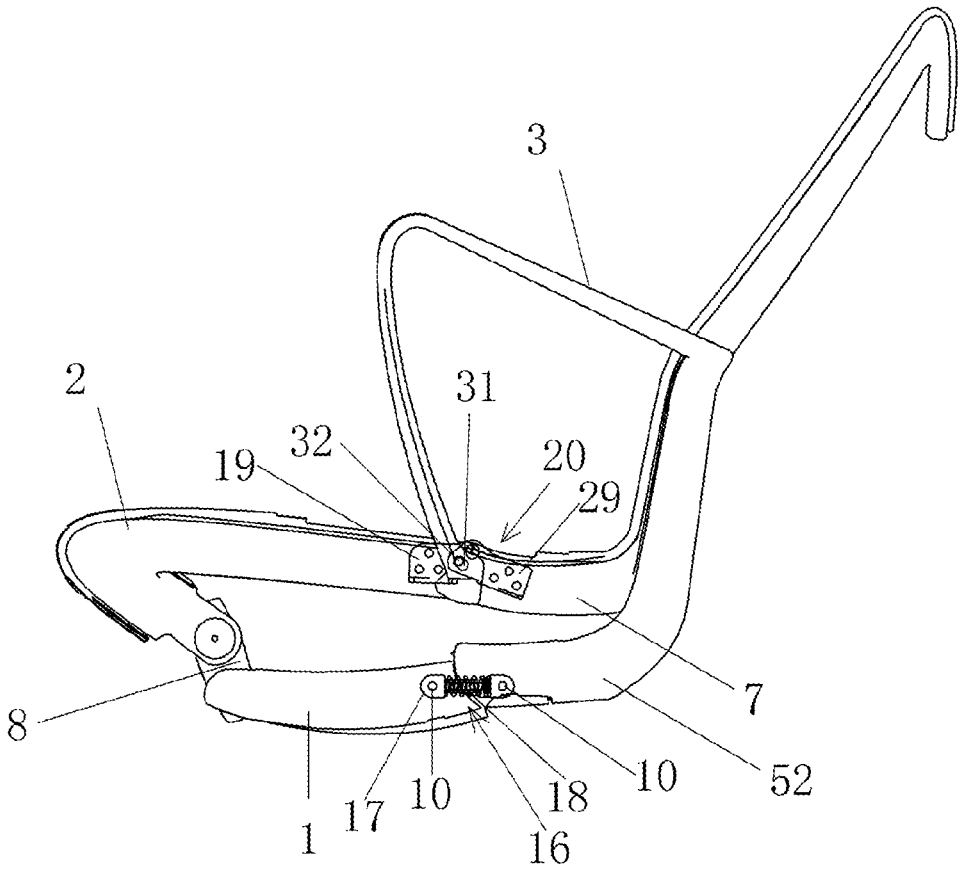
FIG. 4 is a rearward state diagram of one side of the seat structure in the present invention.
Figure 6:
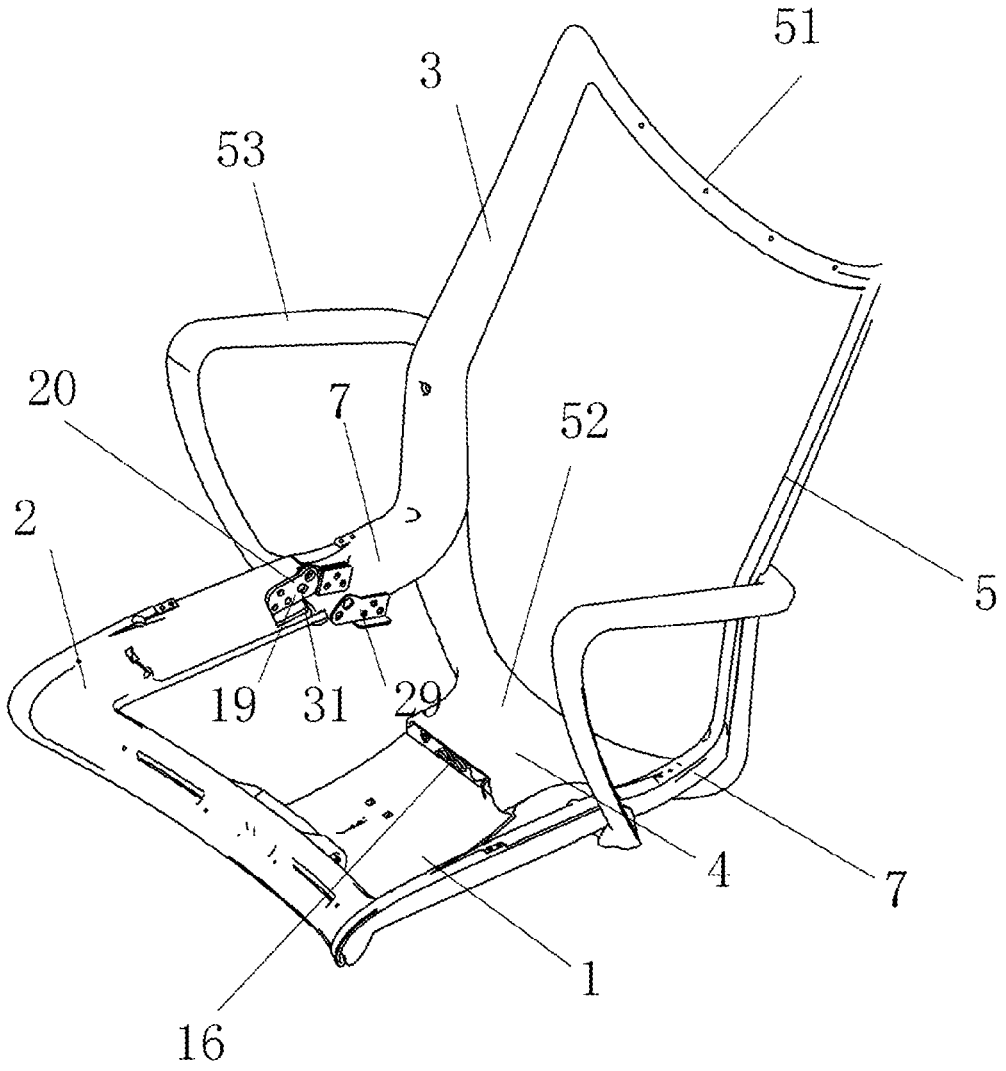
FIG. 6 is a schematic view of the tilting state of the seat structure in the present invention.
Figure 7:
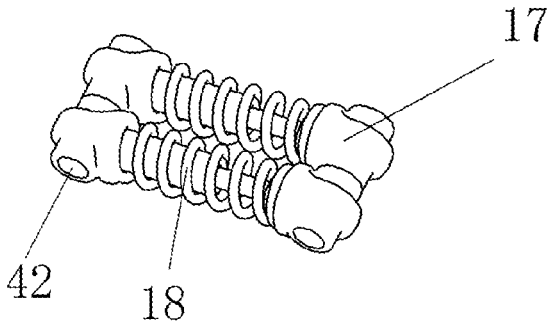
FIG. 7 is a schematic view of the compression spring in the present invention.
Figure 8:
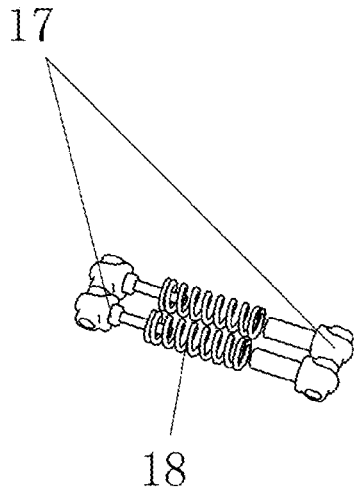
FIG. 8 is an exploded view of the compression spring in the present invention.

The present seat structure forms a four-bar linkage mechanism (see FIG. 3, FIG. 4) by means of seat support 2 which has rotary connection with the front part of the seat through transition link 8, a chair back assembly and a lever driving member. When in use, the force applied on the chair back assembly by human body transfers mutually among the lever driving member, the chair back assembly and the seat support that have rotary connection, thus driving the seat support to be lifted up and down on the base, and then realizing tilt back and forth (see FIG. 5, FIG. 6).

A chair comprising:

Said seat structure;

Chair base assembly; chair base assembly (not shown) includes supporting column, a plurality of supporting legs extending radially from the lower end of the supporting column and casters supporting the leg ends, wherein the supporting column is connected to the base. Said supporting column can be an air rod.

Mesh fabric (not shown), which is stretched from top to bottom on the chair back assembly, the lever driving member and the seat support; said mesh fabric is connected as a whole from top to bottom.

Figure 9:
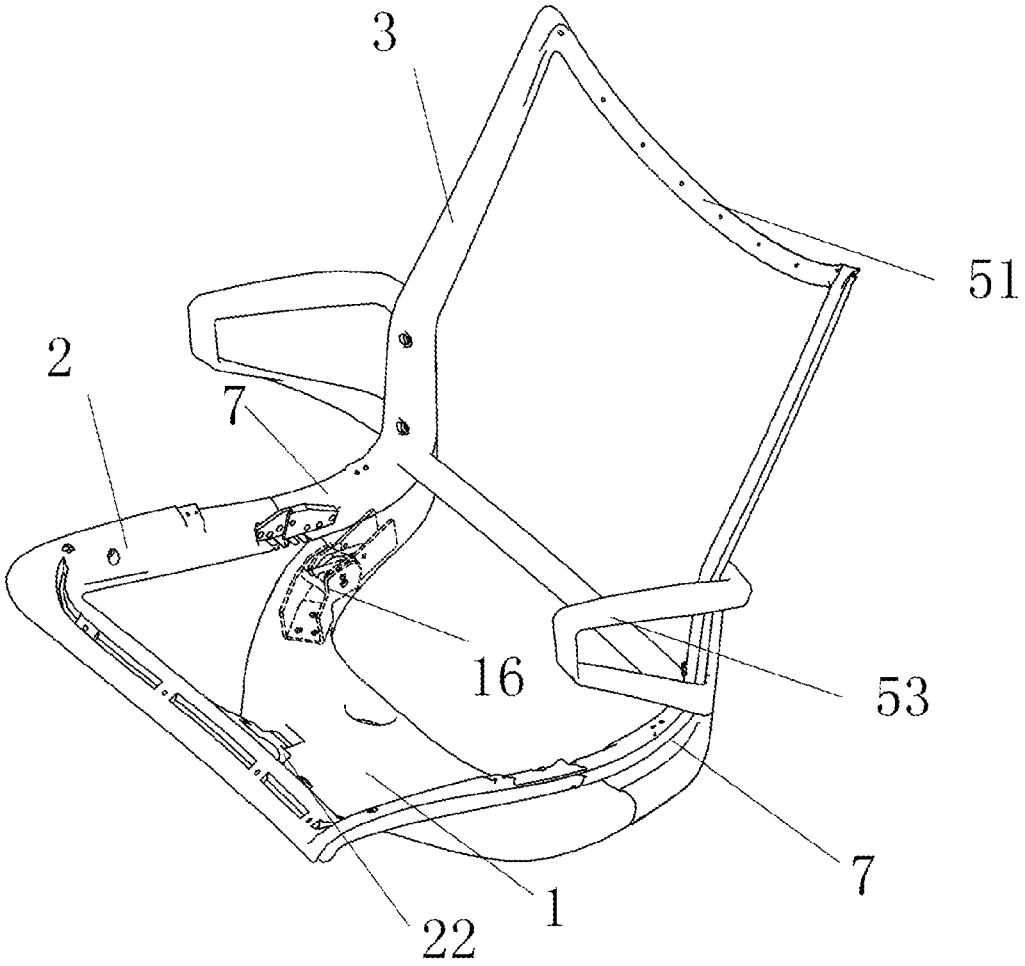
FIG. 9 is a schematic view of the second seat structure in the present invention.
Figure 10:
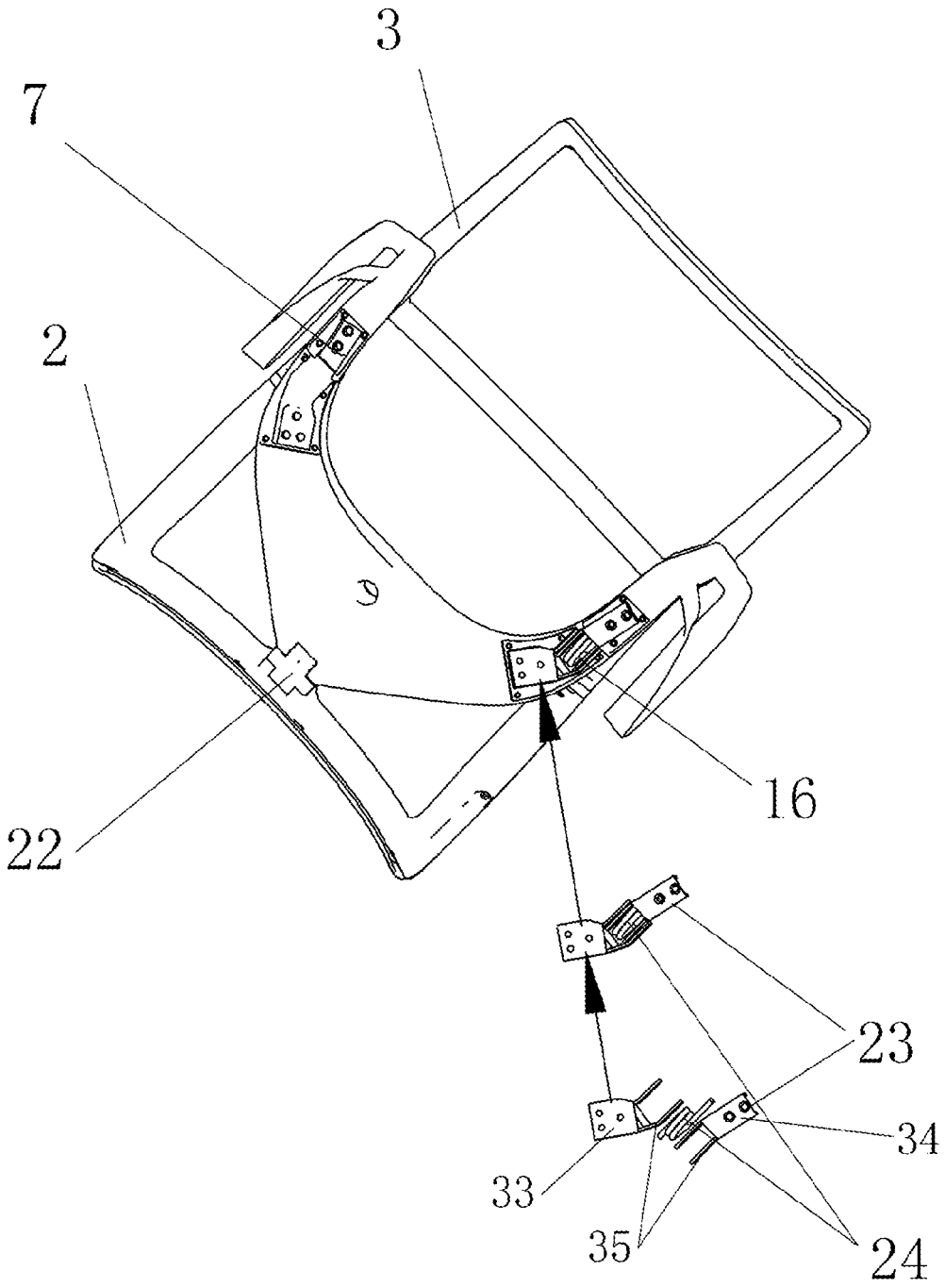
FIG. 10 is a static top view of the second seat structure in the present invention.
Figure 11:
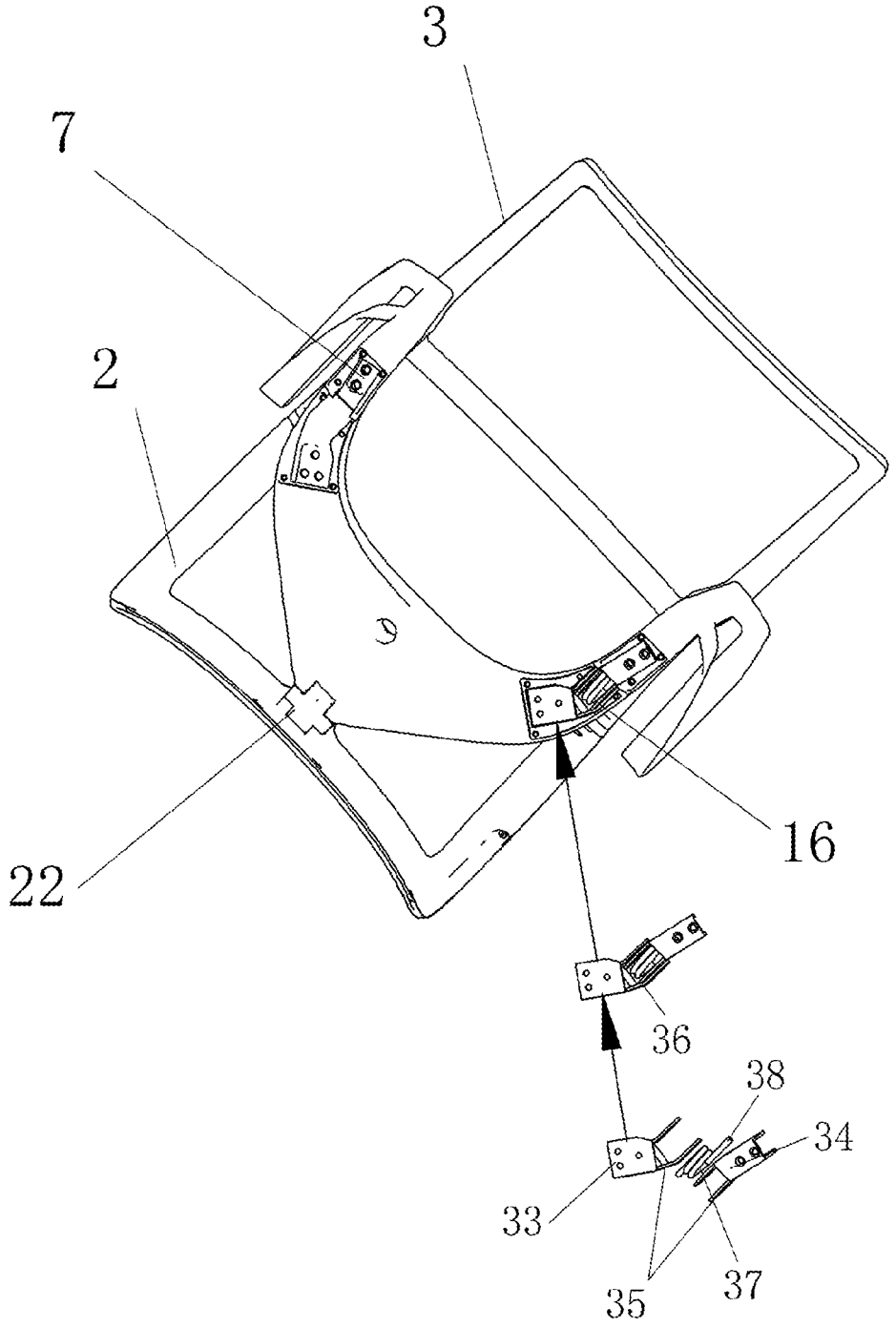
FIG. 11 is a top view of the second seat structure tilting rearward in the present invention.

Embodiment 2:

In the embodiment shown in FIG. 9, FIG. 10, FIG. 11:

A seat structure comprising:

Base 1, configured to be the chair base assembly; base 1 presents a Y shape.

Seat support 2, which is s installed above base 1; the front end of seat support 2 is bending and extending downward and rearward into human body sitting position structure, and seat support 2 has rotary connection with base 1 in a frame structure.

Switch part 22, which is located between seat support 2 and base 1, wherein both ends of switch part 22 have rotary connection with the front part of seat support 2 and the front part of base 1 respectively.

Chair back assembly 3, which has rotary connection with the rear part of base 1 through pivot 6.

Lever driving member 7, which is linked between chair back assembly 3 and seat support 2. When chair back assembly 3 turns rearward from the initial position, seat support 2 is lifted up and moved rearward by lever driving member 7; when chair back assembly is reset, seat support 2 is reset to the initial position by lever driving member 7.

Chair back assembly 3 is an integrated member to match human back structure, which comprises an upper supporting frame of the back 51, a lower supporting frame of the back 52 and two side handrails 53. Lower supporting frame of the back 52 extends forward and is provided with a connecting structure which rotates collaboratively with base 1.

Reset device 16 is provided at the junction of base 1 and chair back assembly 3. Reset device 16 is a torsion spring assembly which comprises torsion spring base 23 and torsion spring 24, wherein torsion spring base 23 is connected to base 1 and chair back assembly 3 respectively, and torsion spring 24 is installed inside torsion spring base 23.

Torsion spring base 23 includes a torsion spring front base 33 and a torsion spring rear base 34, wherein a pair of switch walls 35 are provided on torsion spring front base 33 and torsion spring rear base 34 respectively. Installation cavity 36 is formed with rotary connection of switch walls 35 on torsion spring front base 33 and torsion spring rear base 34. Torsion spring 24 comprises torsion spring body 37 and torque arm 38. Torsion spring 24 is placed inside installation cavity 36 to realize torsion reset.

Lever driving member 7 is a set of connecting links. Connecting link 20 comprises the first connecting link 19 and the second connecting link 29, wherein the first connecting link 19 and seat support 2 are fixed to each other, and the second connecting link 29 is fixed to lever driving member 7. The first connecting link 19 has rotary connection with the second connecting link 29 through axis 30. Either one of the first connecting link 19 and the second connecting link 29 is provided with limit block 39 while the other is provided with limit slot 40.

Figure 12:
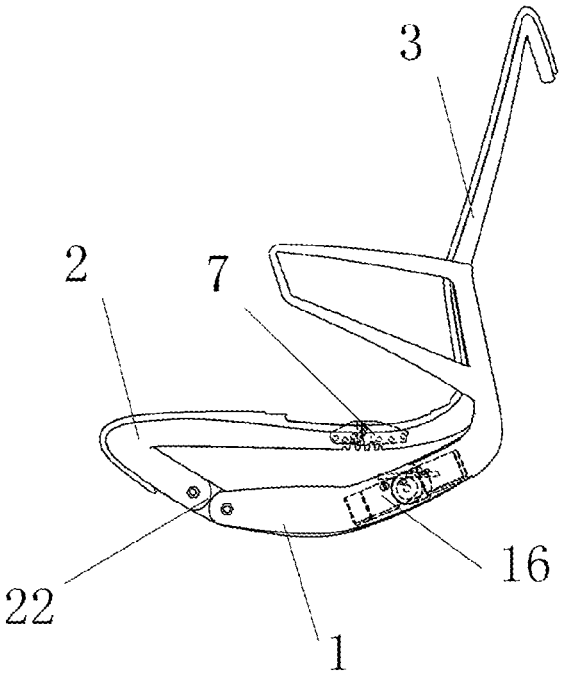
FIG. 12 is an original state diagram of one side of the second seat structure in the present invention.
Figure 13:
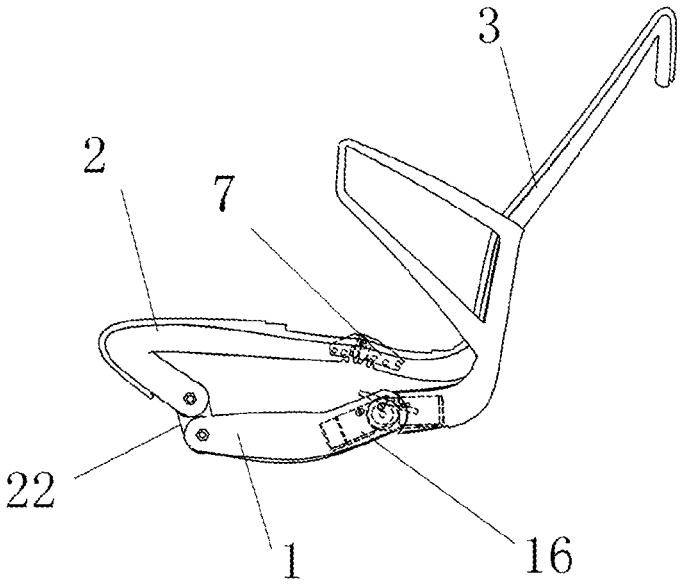
FIG. 13 is a rearward state diagram of one side of the second seat structure in the present invention.
Figure 14:
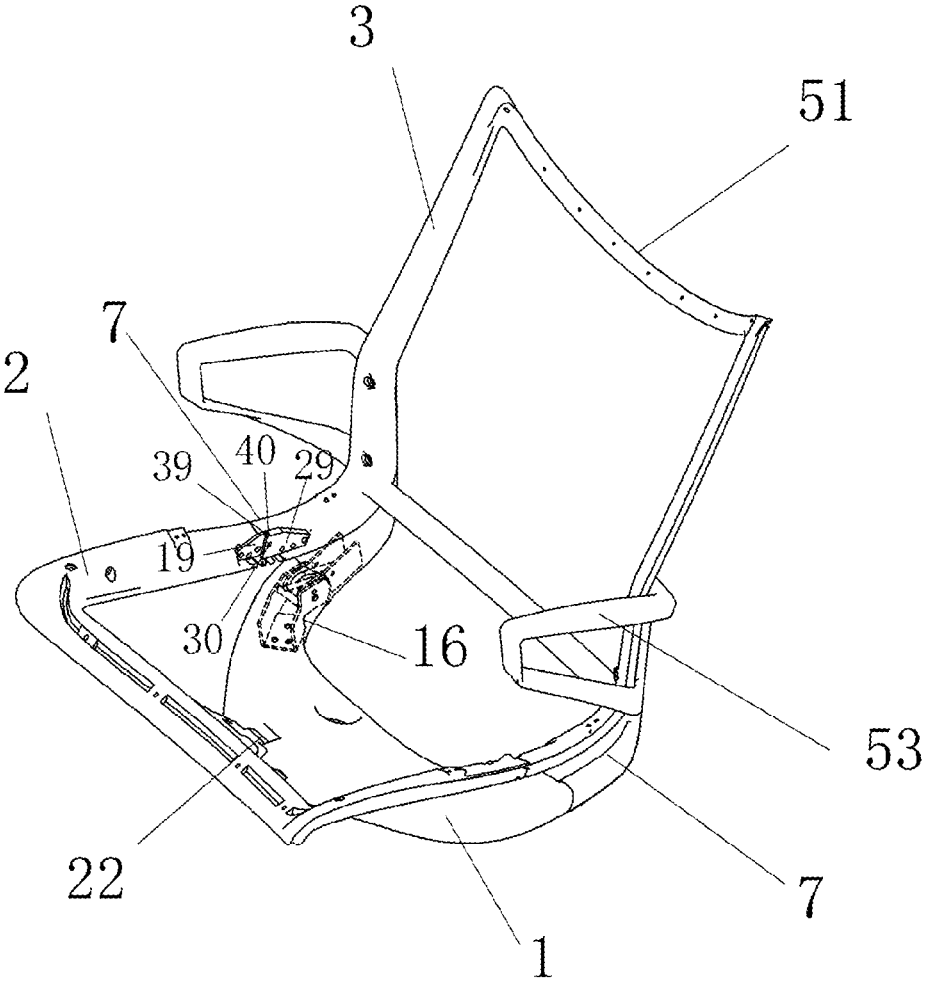
FIG. 14 is a static state diagram of the second seat structure in the present invention.
Figure 15:
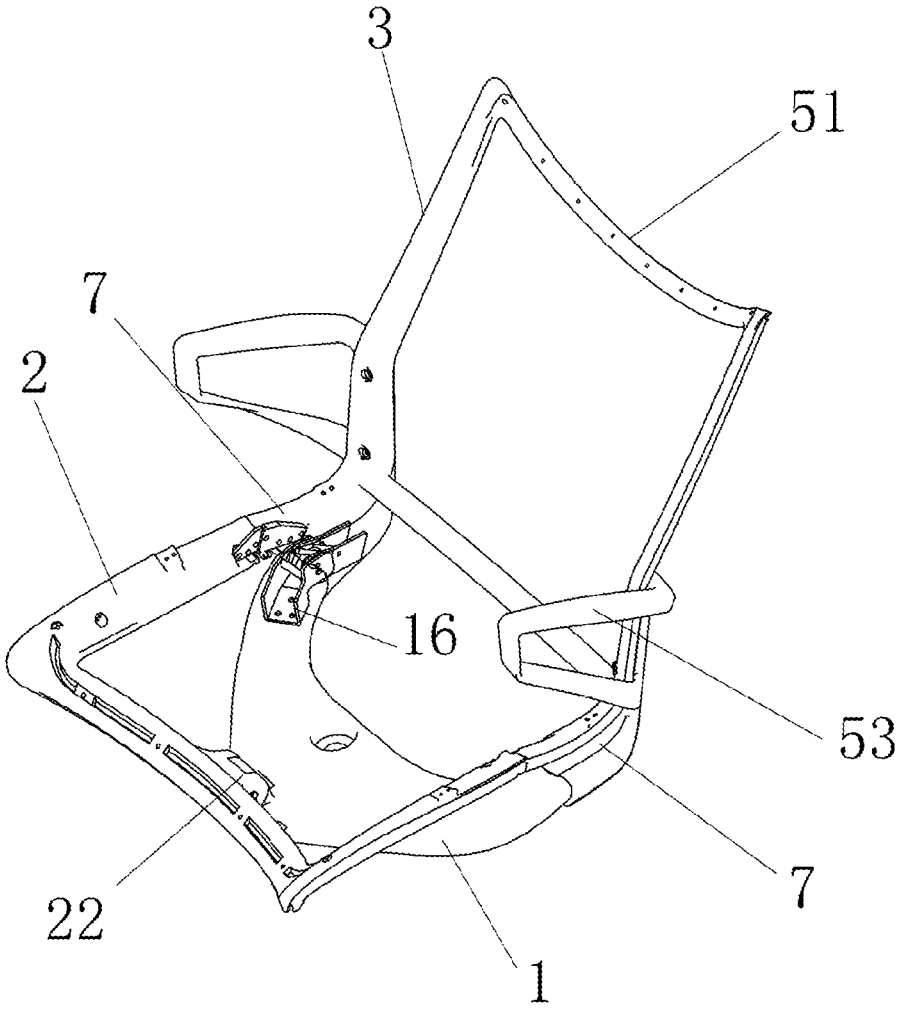
FIG. 15 is a rearward state diagram of the second seat structure in the present invention.
Figure 16:
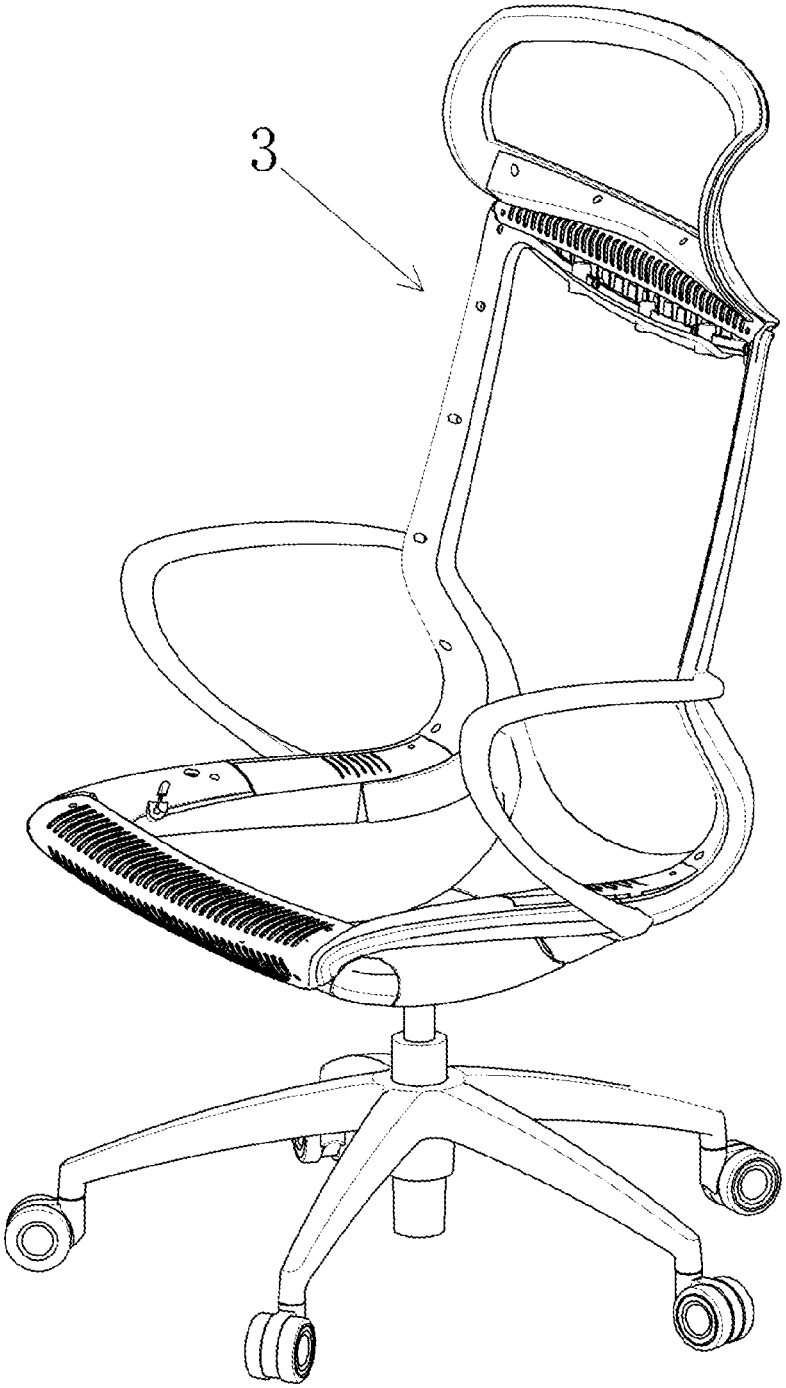
FIG. 16 is a three-dimensional schematic view of the chair in embodiment 3.
Figure 17:
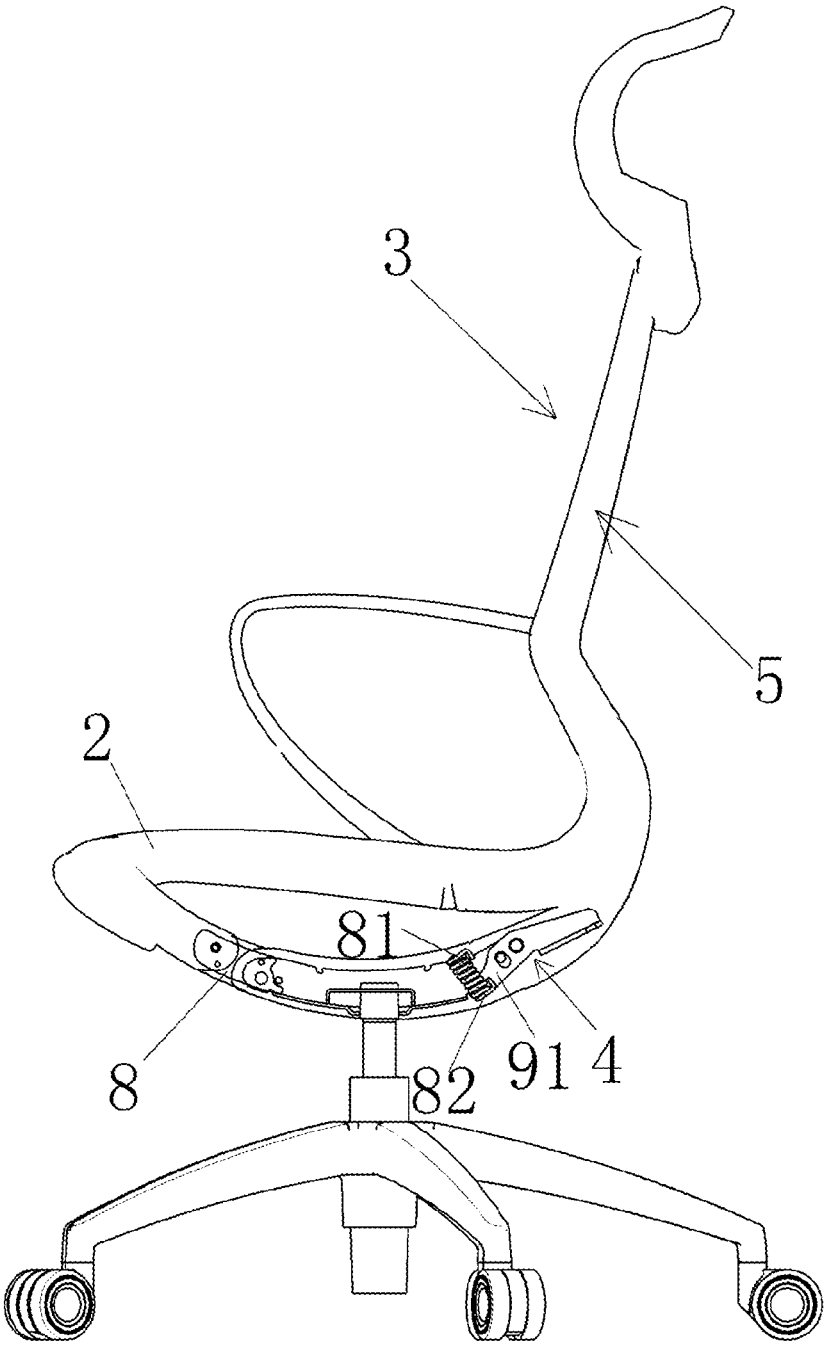
FIG. 17 is a schematic view of the internal plane structure of the chair in embodiment 3.
Figure 18:
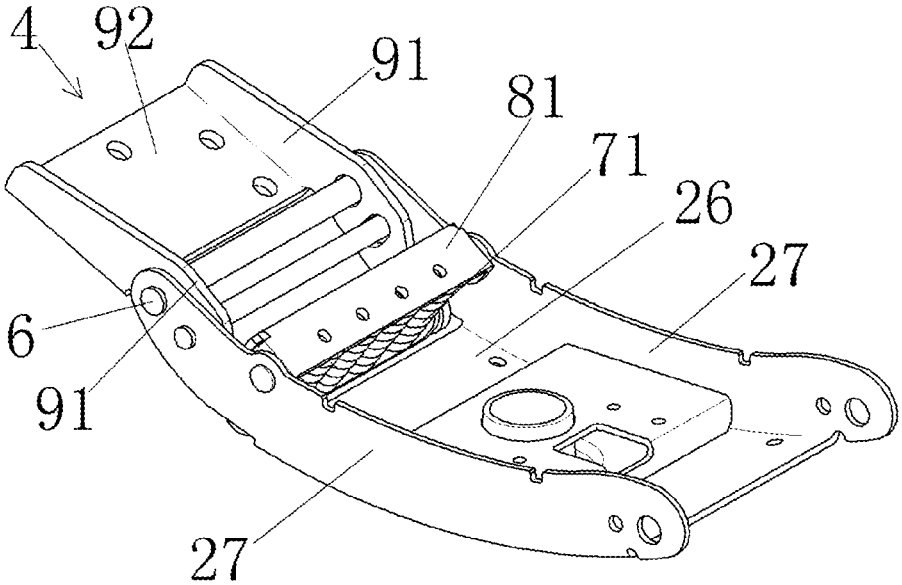
FIG. 18 is a schematic view of the connection structure of the connecting member, the base and the reset spring in embodiment 3.
Figure 19:
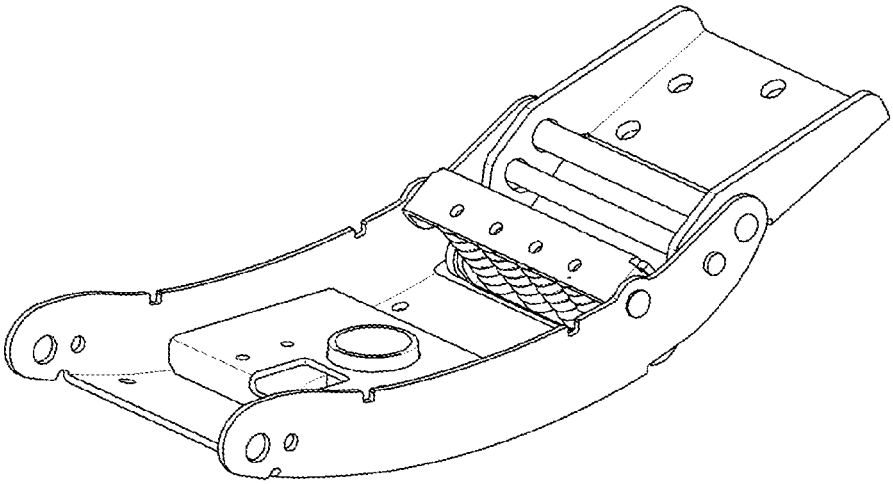
FIG. 19 is a schematic view of the connection structure of the connecting member, the base and the reset spring in embodiment 3 from another angle.
Figure 20:
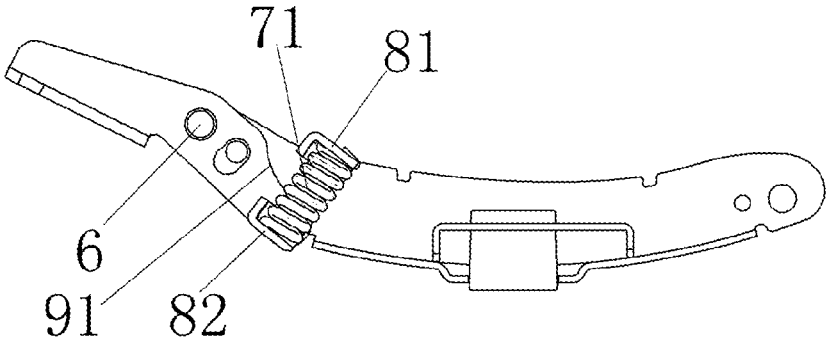
FIG. 20 is a schematic view of the internal plane structure of the configuration of the connecting member, the base and the reset spring in embodiment 3.
Figure 21:
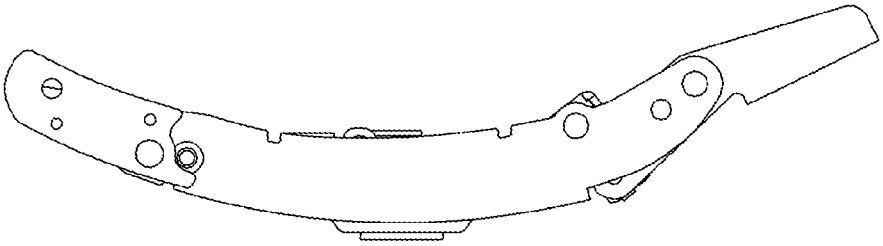
FIG. 21 is a schematic view of the external plane structure of the configuration of the connecting member, the base and the reset spring in embodiment 3.
Figure 22:
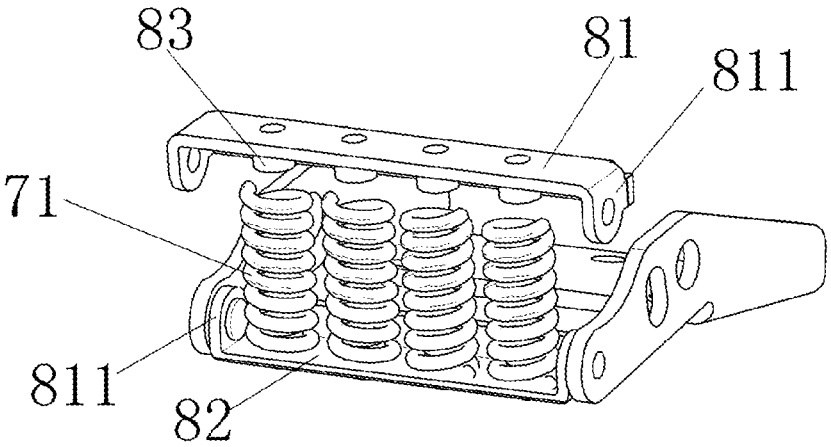
FIG. 22 is a schematic view of the configuration of the reset spring with the upper and lower limit plates in embodiment 3.
Figure 23:
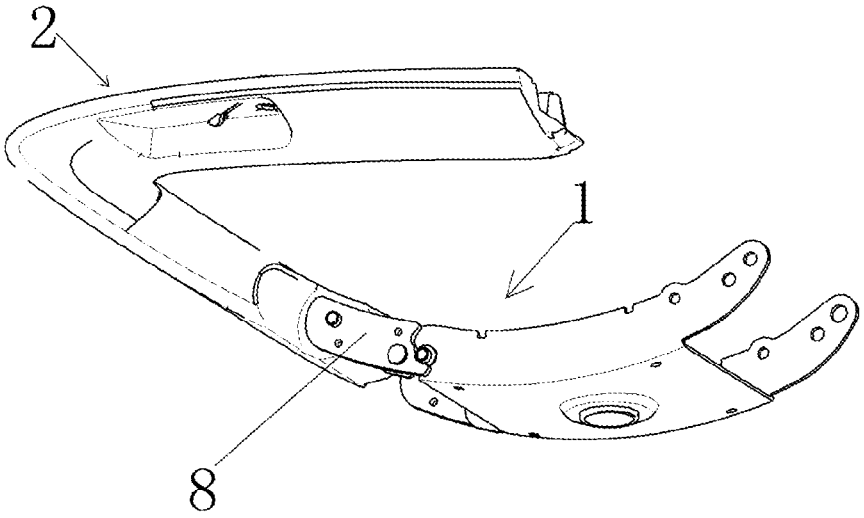
FIG. 23 is a schematic view of the configuration of the seat support with the base through the transition link in embodiment 3.
Figure 24:
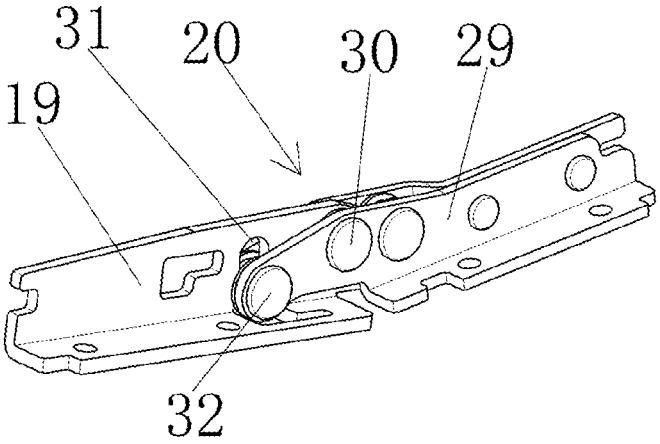
FIG. 24 is a schematic view of the configuration of a set of connecting links in embodiment 3.
Figure 25:
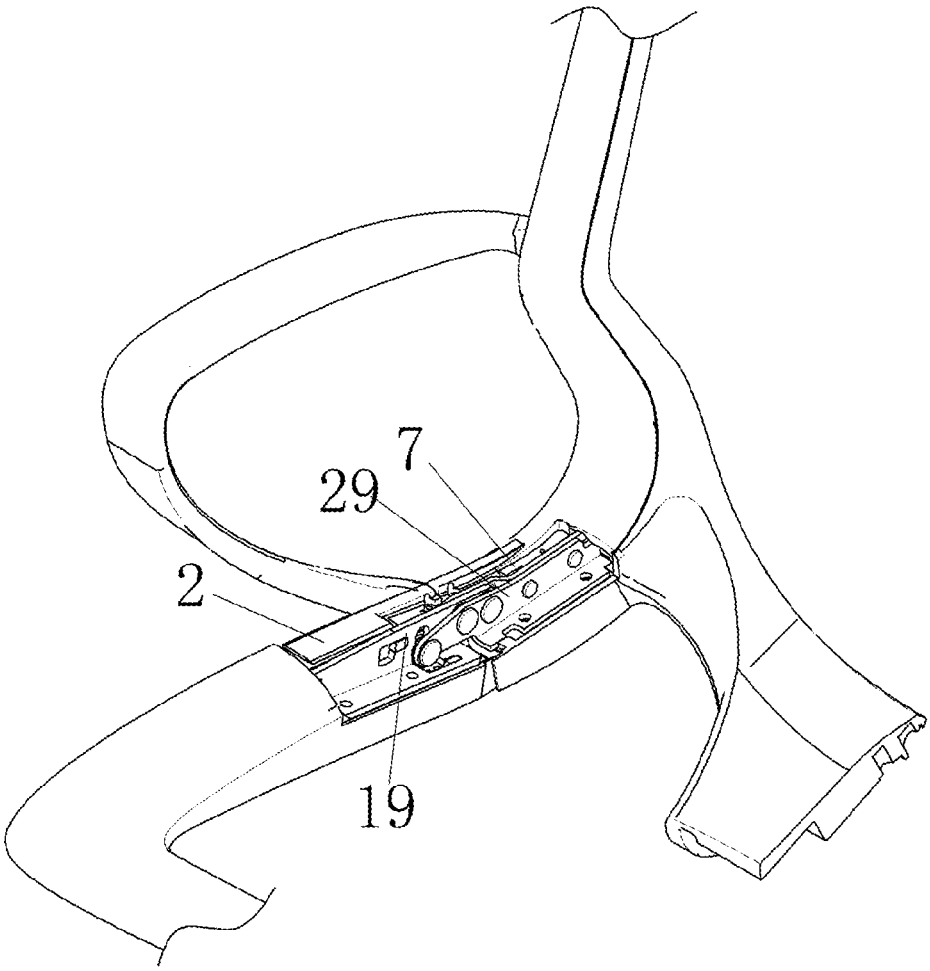
FIG. 25 is a schematic view of the configuration of the seat support with the lever driving member in embodiment 3.

The seat structure can also be provided with a seat support which has rotary connection with the front part of the seat, a switch part, a chair back assembly and a lever driving member, wherein the chair back assembly has direct rotary connection with the rear end of the base, thus forming a lever arm structure. When in use (see FIG. 14, FIG. 15), the force applied on the chair back assembly by human body transfers mutually among the lever driving member, the chair back assembly and the seat support that have rotary connection, thus driving the seat support to be lifted up and down on the base, and then realizing tilt back and forth (see FIG. 12, FIG. 13).

The present embodiment provides a chair comprising:

Said seat structure;

Chair base assembly for supporting the seat structure;

Mesh fabric (not shown), which is stretched from top to bottom on the chair back assembly, the lever driving member and the seat support; said mesh fabric is connected as a whole from top to bottom.

Speaking of said seat structure in above-mentioned embodiment, when human body applies rearward force on chair back assembly 3, chair back assembly 3 moves rearward under the tilting force, and the rearward tilting force is transferred downward to lever driving member 7 through chair back assembly 3 and lever driving member 7 drives seat support 2 to be lifted up and moved rearward, thus realizing rearward tilt of human body and the seat structure. When human body tilts forward, the force applied on chair back assembly 3 disappears, and chair back assembly 3 is reset to the initial position driven by the reset device. Furthermore, the seat structure realizes the rotation among the components through the transition links and a set of lever linkage mechanisms, and limits the position through the position limiting device, which not only makes it easy for the force to apply and transfer, but also enables the components to move more smoothly.

The seat structure and chair can be made from any material and applicable to anyone. The reset device can be set up according to appearance design, body weight, etc., to meet different use requirements and the use of different groups of people. What's more, requirements on comfort in sitting posture can also be fulfilled.

Embodiment 3:

the present embodiment is substantially the same as in embodiment 1 in terms of the relationship between the composition and the structure of the lever driving member, the chair back assembly, the seat support, the transition link and the base. The main difference between this embodiment and embodiment 1 is that, as shown in FIGS. 16-25, reset spring 71 is installed longitudinally between chair back assembly 3 and base 1, to be more specific, reset spring 71 is configured in a position closer to the front than pivot 6, which means the reset spring is completely hidden in the inner space of the base. Thus, the height space inside the base can be fully utilized, and the exterior of the seat will not be protruded by the arrangement of the reset spring, nor will it cause damage to the appearance.

The longitudinal configuration is not strictly defined as longitudinal, and does not necessarily mean that the central line of reset spring 71 coincides with the plumb line. In a broad sense, it means horizontal configuration is excluded. More appropriately, it is roughly consistent with the direction of upward force applied at the lower end of the chair back assembly during rotation.

In particular, said reset spring 71 is a compression spring. The upper end of base 1 is provided with an upper limit plate 81. Reset spring 71 is installed between the lower end of chair back assembly 3 and upper limit plate 81. The upper end of reset spring 71 is limited by upper limit plate 81, so that reset spring 71 is confined in the height space of the base and will not protrude outwards, making full use of the narrow space in the base.

More specifically, as shown in FIGS. 18-21, base 1 comprises a base plate 26 and two side plates 27 extending upward along both sides of base plate 26. Said chair back assembly 3 includes connecting member 4 and bracket 5 served as backrest or chair back. Said connecting member 4 includes laterally symmetrical end plates 91 and connecting plate 92 which connects the two end plates 91. End plate 91 is arranged in parallel with side plate 27, wherein said end plate 91 has rotary connection with side plate 27 through pivot 6. Said upper limit plate 81 is hinged with both side plates 27 of the base through lug 811 which is extending downward at both ends. Connecting member 4 is provided with lower limit plate 82, wherein said lower limit plate 82 is hinged with both end plates 91 through lug 811 which is extending upward at both ends. Reset spring 71 is located between upper limit plate 81 and lower limit plate 82. The upper and lower limit plates 81 & 82 are hinged with base 1 and connecting member 4 respectively, so that when connecting member 4 rotates, the adaptive angle rotation can occur with the rotation arc of the connecting member, and reset spring 71 will follow the motion to make corresponding angle change without causing transverse distortion and deformation to itself, thus giving full play to its own elasticity and prolonging its service life.

Furthermore, reset spring 71 comprises at least two that are arranged side by side, which are installed inside base 1 from left to right. At least two positioning columns 83 are arranged relative on the upper & lower limit plate 81 & 82, and the upper and lower ends of reset spring 71 are coupled with corresponding positioning column 83 respectively.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A seat structure, comprising:

a base, configured to be a chair base assembly;

a seat support, located above the base, wherein a front part of the seat support has rotary connection with a front part of the base through a transition link;

a chair back assembly, having rotary connection with a rear part of the base through a pivot;

a lever driving member, linked between the chair back assembly and the seat support, wherein the lever driving member has rotary connection with a rear part of the seat support, the lever driving member and the seat support are approximately on the same surface, when the chair back assembly rotates rearward around the pivot from an initial position, the rear part of the seat support is raised diagonally to the rear through the lever driving member, meanwhile the transition link and the front part of the seat support are pulled up;

wherein the chair back assembly comprises a connecting member and a bracket, wherein the connecting member has rotary connection with the rear part of the base through the pivot, and the bracket comprises an upper supporting frame of a back and side supporting frames which are extending downward along a left side and a right side of the upper supporting frame of the back, the lever driving member comprises two lever driving members, and the two lever driving members are of lateral symmetry and formed by extending forward from a middle and lower part of the side supporting frame, lower ends of both side supporting frames meet in the middle and extend forward to connect to the connecting member, the seat support comprises two bilaterally symmetrical supporting bars, wherein rear parts of the two supporting bars have rotary connection with the two lever driving members respectively, and front parts of the two supporting bars are connected as a whole through a cross bar, the lever driving member and the supporting bar are approximately connected in a straight line.

2. The seat structure as claimed in claim 1, wherein the base comprises a base plate and two side plates, wherein the base plate is arranged in an arc-shaped structure in fore-and-aft direction.

3. The seat structure as claimed in claim 2, wherein the connecting member presents a U-shape structure, a front end of the connecting member corresponds to a rear end of the base and they have rotary connection through the pivot.

4. The seat structure as claimed in claim 3, wherein the two side plates at a junction of the connecting member and the base are provided with a pivot hole respectively, and the pivot is installed inside the pivot hole.

5. The seat structure as claimed in claim 4, wherein either the base or the connecting member is provided with a long limit hole, while the other is provided with a limit axis, the long limit hole is located in front of the pivot hole, and the connecting member realizes the limit on front and rear tilting through the limit axis.

6. The seat structure as claimed in claim 1, wherein a first limit structure is installed at one end of the seat support which is connected to the transition link, a second limit structure is installed at a junction where the base and the transition link have rotary connection.

7. The seat structure as claimed in claim 6, wherein the first limit structure is an arc-shaped limit block.

8. The seat structure as claimed in claim 6, wherein the second limit structure is an arc-shaped limit block or a limit pin or a limit tooth.

9. The seat structure as claimed in claim 1, wherein the lever driving member has rotary connection with the seat support through a set of connecting links, the set of connecting links comprises a first connecting link and a second connecting link, wherein the first connecting link and the seat support are fixed to each other, and the second connecting link is fixed to the lever driving member, the first connecting link has rotary connection with the second connecting link through an axis, either one of the first connecting link and the second connecting link is provided with a limit hole, while the other is provided with a limit pin shaft.

10. A chair, comprising:

a seat structures as claimed in claim 1;

the chair base assembly for supporting the seat structure;

a mesh fabric, stretched from a top to a bottom on the chair back assembly, the lever driving member and the seat support, the mesh fabric is connected as a whole from the top to the bottom.

11. A seat structure, comprising:

a base, configured to be a chair base assembly;

a seat support, located above the base, wherein a front part of the seat support has rotary connection with a front part of the base through a transition link;

a chair back assembly, having rotary connection with a rear part of the base through a pivot;

a lever driving member, linked between the chair back assembly and the seat support, wherein the lever driving member has rotary connection with a rear part of the seat support, the lever driving member and the seat support are approximately on the same surface, when the chair back assembly rotates rearward around the pivot from an initial position, the rear part of the seat support is raised diagonally to the rear through the lever driving member, meanwhile the transition link and the front part of the seat support are pulled up; and a reset spring, installed longitudinally between the chair back assembly and the base, which provides counter force when the chair seat assembly rotates rearward, wherein the reset spring is a compression spring, an upper end of the base is provided with an upper limit plate, the reset spring being installed between a lower end of the chair back assembly and the upper limit plate.

12. The seat structure as claimed in claim 11, wherein the reset spring is arranged in a position closer to the front than the pivot.

13. The seat structure as claimed in claim 11, wherein the base comprises a base plate and two side plates extending upward along both sides of the base plate, the chair back assembly includes a connecting member and a bracket, the connecting member includes two laterally symmetrical end plates and a connecting plate which connects the two laterally symmetrical end plates, the two laterally symmetrical end plates have rotary connection with the two side plates through the pivot, the upper limit plate is hinged with the two side plates of the base through a lug at both ends, the connecting member is provided with a lower limit plate, wherein the lower limit plate is hinged with the two end plates through the lug at the both ends, the reset spring is located between the upper limit plate and the lower limit plate.

14. The seat structure as claimed in claim 13, wherein the reset spring comprises at least two reset springs, there are the at least two reset springs being arranged side by side, at least two positioning columns are disposed on the upper limit plate and the lower limit plate, and an upper end and a lower end of each of the at least two reset springs are coupled with corresponding positioning columns, respectively.

* * * * *